US005137580A

United States Patent [19]

Honda

[11] Patent Number: 5,137,580

[45] Date of Patent: Aug. 11, 1992

[54] CLEANING METHOD FOR USING GENERATION OF CAVITATION

[75] Inventor: Keisuke Honda, Aichi, Japan

[73] Assignee: Honda Electronics Co., Ltd., Aichi, Japan

[21] Appl. No.: 436,064

[22] Filed: Nov. 13, 1989

[30] Foreign Application Priority Data

Feb. 16, 1989 [JP] Japan ..... 1-37013

[51] Int. Cl.[5] ..... B08B 3/12

[52] U.S. Cl. ..... 134/1; 134/25.1; 134/25.4

[58] Field of Search ..... 134/1, 25.1, 25.4, 18

[56] References Cited

U.S. PATENT DOCUMENTS 3,963,984 6/1976 Coulter ..... 134/1

*Primary Examiner*—Curtis R. Davis

*Attorney, Agent, or Firm*—Burgess, Ryan & Wayne

[57] ABSTRACT

Ultrasonic waves of a low frequency and a high frequency are alternately emitted from one vibrator to liquid in a tank, cavitation generated due to the ultrasonic wave of the low frequency is eliminated and changed to small cavitation for forming the next large cavitation due to the ultrasonic wave of the high frequency and next the ultrasonic wave of the low frequency is emitted to the liquid in a tank and large cavitation is formed, whereby the cleaning effect is improved.

2 Claims, 4 Drawing Sheets

PRIOR ART

CLEANING METHOD FOR USING GENERATION OF CAVITATION

BACKGROUND OF THE INVENTION

The present invention relates to a cleaning method using the generation of cavitation in which bubbles in liquid are eliminated by ultrasonic waves, and thus, the generation of cavitation becomes easy, such that the cleaning effect is improved.

Generally, in a cleaning method using an ultrasonic wave, cavitation is generated due to the ultrasonic wave emitted in liquid and the stain on the thing to be cleaned is removed from it due to an impulse wave form the generation of cavitation. When the ultrasonic wave is emitted in the liquid, small gaseous bodies dissolved in the liquid are compressed and expanded, thus generating the cavitation in a liquid. Accordingly, cleaning may be executed by impulse waves which are generated due to generation and elimination of cavitation in the liquid.

In a cleaning apparatus (see FIG. 1) using an ultrasonic wave of one frequency, when a signal of one frequency from an oscillator 3 is supplied to a vibrator 2 and the ultrasonic wave of the one frequency is generated from the vibrator 2 attached to a cleaning tank 1, cavitation generates in portion corresponding to large amplitudes of the standing wave as shown at A.

In such a cleaning method, however, because cavitation is not generated in the small amplitude portion of the standing wave, cleaning is not uniformly performed. Also, in such method, because the ultrasonic wave is not transmitted to all areas of the tank 1 due to the cavitation in the large amplitude portion of standing wave, the cavitation is not effectively generated in all areas in the tank 1.

For solving such defect, the applicant provided an asymmetric Langevin type vibrator 8 in which piezoelectric vibrators 7 and electrode *7a* and *7b* are put between a long metal block 5 and a short metal block 6 and screw threads at both ends of a bolt are engaged with screw threads of the metal blocks 5 and 6 (see FIG. 2).

This vibrator 8 can generate ultrasonic waves having a resonance frequency $f_1$ of a length between the long metal block 5 and the piezoelectric vibrator 7. A resonance frequency $f_2$ of a length between the short metal block 6 and the piezoelectric vibrator 7 and a resonance frequency $f_3$ of all length of the vibrator 8.

As shown in FIG. 3, when signals of frequencies $f_1$, $f_2$ and $f_3$ are applied to the vibrator 8 from every predetermined time period ultrasonic waves oscillators 10, 11 and 12 by switching a switch 9 having frequencies $f_1$, $f_2$ and $f_3$ are respectively generated from the vibrator 8 every predetermined time period. Because the positions of large amplitudes of the ultrasonic waves are different from each other as shown in dotted lines A, cavitation can be generated in different positions of liquid 4 in the tank 1. Therefore, the cleaning effect in this cleaning method is improved in comparison with the cleaning method of the one frequency.

In this cleaning method, however, because cavitation is not generated between the dotted lines A in the liquid 4, cleaning is not uniformly performed. Because cavitation is generated in the position of the large amplitudes in the ultrasonic wave when a standing wave is generated with the ultrasonic wave of one frequency, an additional supply of power of the ultrasonic wave is restrained by the cavitation.

When the ultrasonic wave is changed to another frequency and the pattern of the standing wave is changed, cavitation generated with the ultrasonic wave of one frequency is scattered with the ultrasonic wave of the other frequency. Then, cavitation remains in the position of the large amplitude of the standing wave in the next ultrasonic wave and it becomes the origin in the next cavitation.

SUMMARY OF THE INVENTION

It is, therefore, the primary object of the present invention to provide a cleaning method using cavitation in which the cleaning effect is improved with a simple constitution.

In order to accomplish the above and other objects, the present invention comprises the step of alternately emitting pulse-like ultrasonic waves of low frequency and pulse-like ultrasonic waves of high frequency at very short time intervals to liquid in a cleaning tank, whereby large cavitation generated with the ultrasonic wave of low frequency is changed to small cavitation with the ultrasonic wave of high frequency and small cavitation is formed to become the origin for the next large cavitation, and the large cavitation is effectively generated in all areas of the cleaning tank.

DESCRIPTION OF THE PREFERRED EMBODIMENTS

Figure 1:
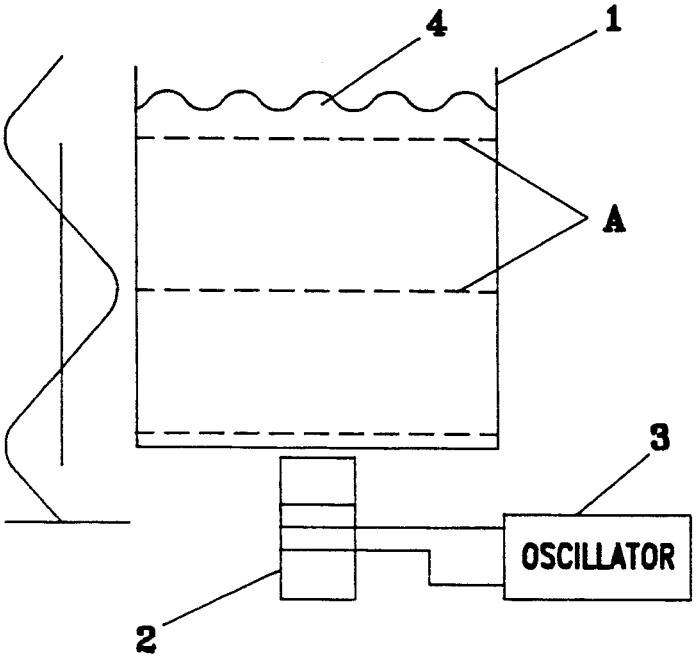
FIG. 1 shows a view for explaining a cleaning method using an ultrasonic wave in the prior art.
Figure 2:
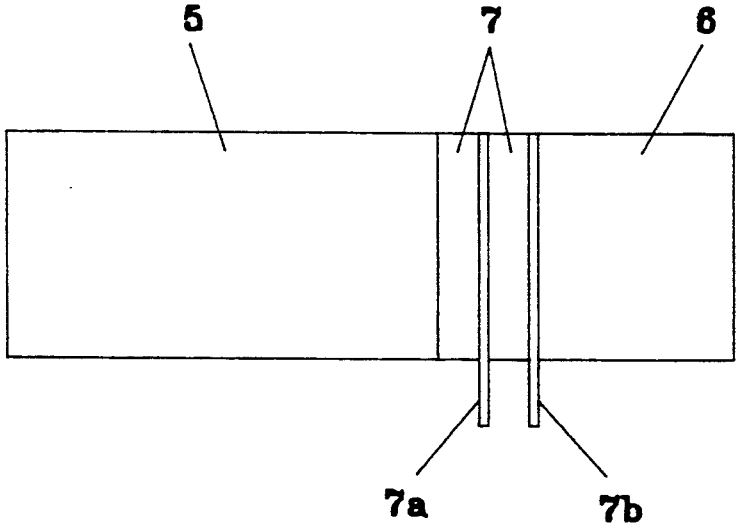
FIG. 2 shows a side view of a multi-frequency vibrator proposed by the present invention.
Figure 3:
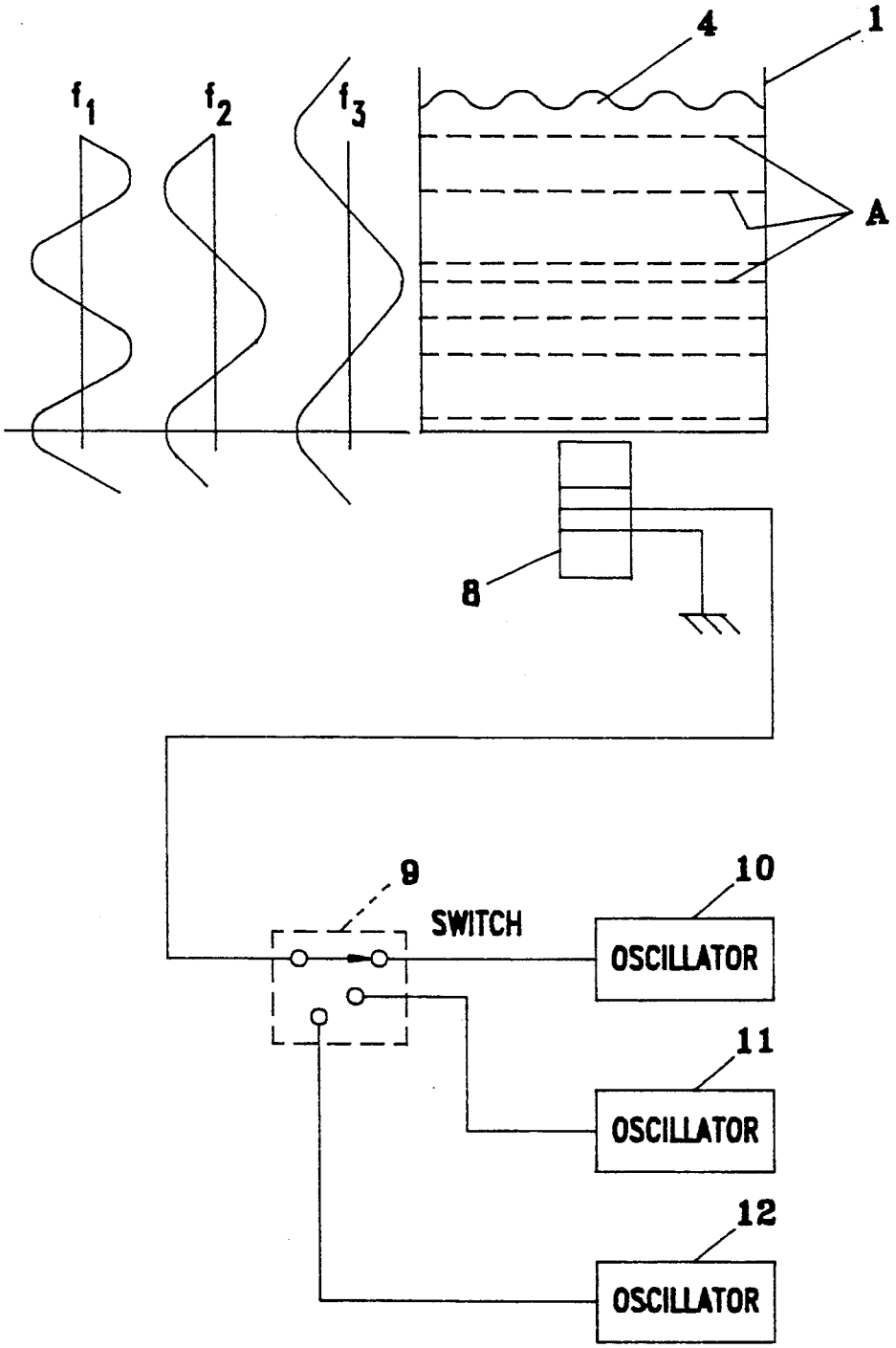
FIG. 3 shows a view for explaining the prior cleaning method using the vibrator in FIG. 2.
Figure 4:
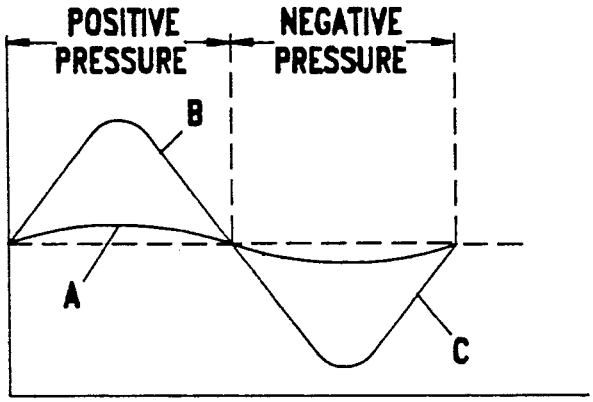
FIG. 4 shows a wave form of an ultrasonic wave for explaining the principle of the present invention.

The principle of the present invention will be explained before an embodiment of the present invention is explained. Referring to the curved line A in FIG. 4 in which an ultrasonic wave form is shown, when sound pressure of the large amplitude of the ultrasonic wave the same as atmospheric pressure, the surface of the liquid in the tank is only vibrated. When the sound pressure of the large amplitude of ultrasonic wave is more than the atmospheric pressure, the sound pressure becomes higher than atmospheric pressure in its half cycle as shown in curved line B and the sound pressure becomes lower than atmospheric pressure in its half cycle as shown in curved line C. In this half cycle C in which its pressure becomes lower than the atmospheric pressure, because a vacuum condition arises in the liquid and cavitation of zero or negative pressure arises in the liquid, the gaseous body dissolved in liquid is vaporized and a plurality of small bubbles generate. Such phenomenon in which a cavity is generated in the liquid due to tearing the liquid is called "cavitation".

The bubbles generated with the cavitation in the half cycle C are raised in the liquid due to buoyancy and the gaseous body in the bubbles is discharged in the atmosphere. Therefore, in the cleaning using the ultrasonic wave of the one frequency, the bubbles are generated due to the cavitation in only the high amplitude positions of the ultrasonic wave. Also, in the cleaning using the ultrasonic waves of the three frequencies, the bubbles are generated due to cavitation in only the respective high amplitude positions.

Then, if the bubbles generated due to the cavitation in the half cycle C remain in the generated positions, because the high sound pressure larger than the atmospheric pressure is added to the bubbles in the next cycle B, the bubbles are pressed and become small. Then, because the negative pressure is added to the bubbles in the next cycle C, the bubbles are explosively expanded and are broken. Therefore, the sound pressure is more amplified by the break of the bubbles.

The bubbles generated due to cavitation in the half cycle C do not remain in the generated portions. Accordingly, the thing may be cleaned when the cavity is generated by the ultrasonic wave. Therefore, in the cleaning methods using the one frequency and the three frequencies, because the cleaning is performed by cavitation in only the large amplitude portions of the ultrasonic wave, the cleaning is not uniformly performed.

Figure 5:
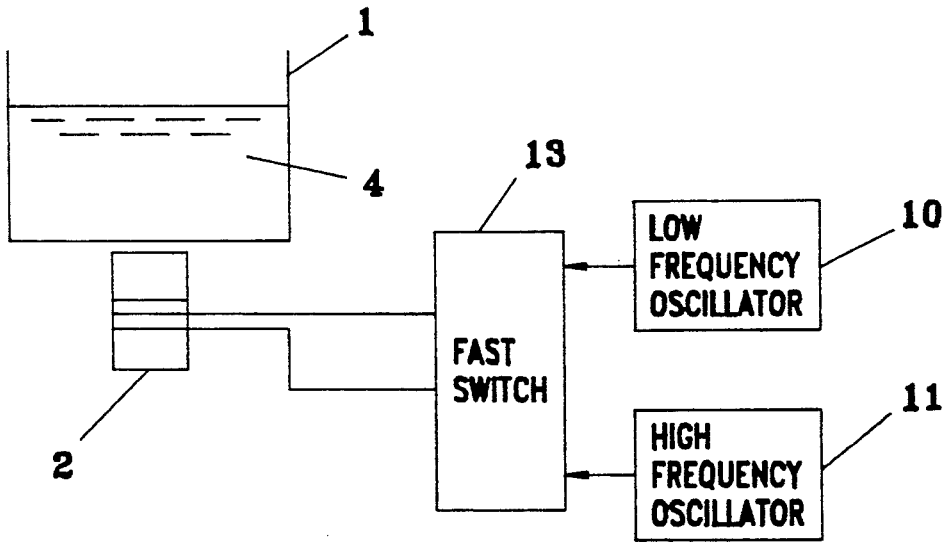
FIG. 5 shows a block diagram for explaining an embodiment according to the present invention.

Referring to FIG. 5, in the cleaning method according to the present invention, the vibrator 2 is connected through a fast switch 13 to an oscillator 10 of low frequency $f_1$ and an oscillator 11 of high frequency $f_2$. Then, after a signal from the oscillator 10 is supplied through the fast switch 13 to the vibrator 2 at a very short time interval (a few milli-seconds to 10 milli-seconds) and an ultrasonic wave of low frequency $f_1$ is generated from the vibrator 2 in the very short time interval, a signal from the oscillator 11 is supplied through the fast switch 13 to the vibrator 2 in a very short time interval (a few ms to 10 ms) and an ultrasonic wave of the high frequency $f_2$ is generated from the vibrator 2 in the very short time interval.

Figure 6A:
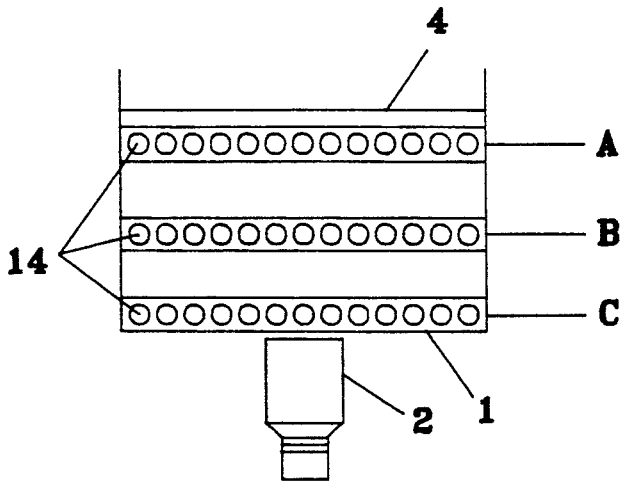
FIGS. 6A–6C show views for explaining the principle of the present invention.
Figure 6B:
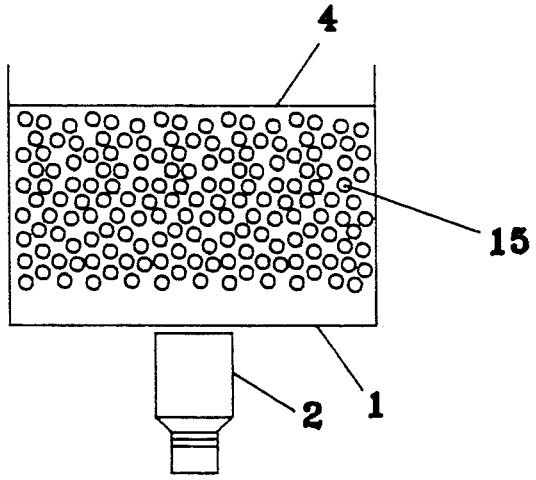
Figure 6C:
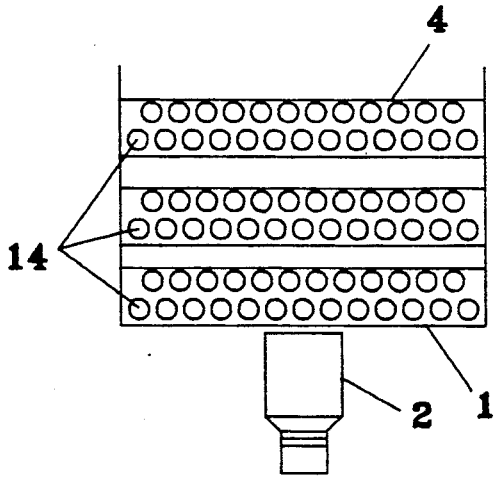

In the present invention, as shown in FIG. 6 (*a*), firstly large bubbles 14 are generated at areas A, B and C in liquid 4 in the tank 1 due to the ultrasonic wave of the low frequency $f_1$. Then, even if the same ultrasonic wave of the low frequency $f_1$ is next emitted in the liquid 4, the ultrasonic wave is reflected nearly 100% by the large bubbles 14 in the area C. Therefore, when the large bubbles 14 are shifted from the large amplitude portions A, B and C to the upper positions due to buoyancy, the ultrasonic wave of the high frequency $f_2$ from the vibrator 2 is emitted to the liquid 4, whereby the large bubbles 14 generated due to the ultrasonic wave of the low frequency $f_1$ are broken by the high sound pressure of the ultrasonic wave of the high frequency $f_2$ and small bubbles 15 forming the next large bubbles are generated as shown in FIG. 6(*b*). Also, when the ultrasonic wave of the low frequency $f_1$ is emitted to the liquid 4 in the tank 1, the large bubbles 14 are explosively generated due to the small bubbles 15. Therefore, as shown in FIG. 6(*c*), the large bubbles 14 are spread in the whole of the tank 1. A large cleaning effect is obtained by forming and breaking large bubbles 14 with the ultrasonic waves of the high frequencies $f_1$ and $f_2$.

In the present invention, the large bubbles 14 generated with the ultrasonic wave of the low frequency $f_1$ are broken with the ultrasonic wave of the high frequency $f_2$ and the small bubbles 15 are formed. Then, a plurality of large bubbles 14 are generated by the small bubbles 15 in the whole of the liquid 14 in the tank 1 and are broken with the next ultrasonic wave of the high frequency $f_2$. The cleaning effect is improved by the forming and the breaking of the large bubbles 14.

What is claimed is:

1. A cleaning method using cavitation, comprising the step of alternately emitting a pulse-like ultrasonic wave of a first frequency and a ultrasonic wave of a second, higher frequency to a liquid in a cleaning tank, whereby a first cavitation generated with the ultrasonic wave of the first frequency is changed to a second, smaller cavitation with the ultrasonic wave of the second frequency and the second cavitation provides a basis of the next generation of a first cavitation, so that the first cavitation is effectively generated in all areas of the cleaning tank.

2. A cleaning method for using cavitation as set forth claim 1 wherein times for emitting ultrasonic waves of low frequency and high frequency are 1 ms to 10 ms respectively.

* * * * *